US007634451B2

(12) United States Patent
Gömer et al.

(10) Patent No.: US 7,634,451 B2
(45) Date of Patent: Dec. 15, 2009

(54) MULTIVARIATE, PREDICTIVE REGULATION OF A DIRECT REDUCTION PROCESS

(75) Inventors: Franz Gömer, Herzogenaurach (DE); Bernhard Lang, München (DE); Stephen Craig Montague, Midland, NC (US)

(73) Assignee: Siemens Aktiengesellschaft, Munich (DE)

( * ) Notice: Subject to any disclaimer, the term of this patent is extended or adjusted under 35 U.S.C. 154(b) by 454 days.

(21) Appl. No.: 10/545,669

(22) PCT Filed: Feb. 11, 2004

(86) PCT No.: PCT/EP2004/001275

§ 371 (c)(1),
(2), (4) Date: Aug. 15, 2005

(87) PCT Pub. No.: WO2004/072309

PCT Pub. Date: Aug. 26, 2004

(65) Prior Publication Data

US 2006/0149694 A1 Jul. 6, 2006

(30) Foreign Application Priority Data

Feb. 13, 2003 (DE) ..... 103 06 024

(51) Int. Cl.
*G06E 1/00* (2006.01)
*G06G 7/12* (2006.01)

(52) U.S. Cl. ..... 706/21; 706/23; 706/19

(58) Field of Classification Search ..... 706/21, 706/23, 19; 700/28, 67
See application file for complete search history.

(56) References Cited

U.S. PATENT DOCUMENTS

| | | | | |
|---|---|---|---|---|
| 4,093,455 | A | 6/1978 | Pietsch | |
| 4,178,151 | A | 12/1979 | Huestis | |
| 4,234,169 | A | 11/1980 | Scarlett et al. | |
| 5,408,424 | A * | 4/1995 | Lo | 708/303 |
| 5,796,920 | A * | 8/1998 | Hyland | 706/20 |
| 6,216,048 | B1 * | 4/2001 | Keeler et al. | 700/44 |

FOREIGN PATENT DOCUMENTS

| | | |
|---|---|---|
| EP | 0 907 117 A1 | 4/1999 |
| WO | 99/23264 | 5/1999 |
| WO | 02/097138 | 12/2002 |

OTHER PUBLICATIONS

Chatterjee et al., Amit, "Flow of Materials in Rotary Kilns Used for Sponge Iron Manufacture: Part II. Effect of Kiln Geometry", Metallurgical Transactions, Mar. 1981.*
Chatterjee et al., Amit, "Flow of Materials in Rotary Kilns Used for Sponge Iron Manufacture: Part III. Effect of Ring Formation within the Kiln", Metallurgical Transactions, Mar. 1981.*

(Continued)

*Primary Examiner*—David R Vincent
*Assistant Examiner*—Adrian L Kennedy
(74) *Attorney, Agent, or Firm*—Staas & Halsey LLP

(57) ABSTRACT

For the prognosis of a value of a characteristic of a product which is to be produced with the aid of a neuronal network, the history of the product is taken into account when determining an input variable of an input neuron of the neuronal network.

10 Claims, 2 Drawing Sheets

OTHER PUBLICATIONS

Chen, Jian, "A predictive system for blast furnaces by integrating a neural network with qualitative analysis", Engineering Application of Artificial Intelligence, Jun. 1999.*

Radhakrishnan et al., V.R., "Neural networks for the identiacation and control of blast furnace hot metal quality", Journal of Processs Control 10, 2000.*

Chatterjee et al., Amit, "Flow of Materials in Rotary Kilns Used for Sponge Iron Manufacture: Part III. Effect of Ring Formation within the Kiln", Metallurgical Transactions, Mar. 1981.*

Radharkrishnan et al., V.R., "Neural networks for the identification and control of blast furnace metal quality", Journal of Process Control 10, 2000.*

Thompson, M., "Control Innovations in MIDREX Plants: An Introduction," pp. 3-5 in Direct from MIDREX, pp. 2-11, 2001.

Gömer, F. et al., "Development of Process Automation for the MIDREX Process," pp. 3-5 in Direct from MIDREX, pp. 2-11, 2002.

Katsumata et al., "A Predictive I-PD Controller for the Processes with Long Deadtimes Using Neural Networks," IEEE International Conference on Neural Networks, 1994, pp. 3154-3157.

Li, J. et al., "Artificial Neural Networks-based Predictive Control," Proceedings of the International Conference on Industrial Electronics, 1991, pp. 1405-1410.

Bressloff, P.C., "Temporal Processing in Neural Networks with Adaptive Short Term Memory: A Compartmental Model Approach," Network: Computation in Neural Systems, vol. 4, 1993, pp. 155-172.

Zhang Hui et al., "The Application of Neural Nets: The Design of Recursive Digital Filters," China 1991 International Conference on Circuits and Systems, 1991, pp. 549-551.

International Search Report for PCT/EP2004/001275 mailed Sep. 24, 2004.

Bressloff, P.C., "Temporal Processing in Neural Networks with Adaptive Short Term Memory: A Compartmental Model Approach," Network: Computation in Neural Systems, vol. 4, 1993, pp. 155-175.

M. Duhoux et al., "Improved long-term temperature prediction by chaining of neural networks", International Journal of Neural Systems, Feb. 2001, pp. 1-10,.

* cited by examiner

MULTIVARIATE, PREDICTIVE REGULATION OF A DIRECT REDUCTION PROCESS

CROSS REFERENCE TO RELATED APPLICATIONS

This application is based on and hereby claims priority to German Application No. 10306024.3 filed on Feb. 13, 2003, the contents of which are hereby incorporated by reference.

BACKGROUND OF THE INVENTION

The direct reduction of iron ore to the product sponge iron in the form of DRI (Direct Reduced Iron) or HBI (Hot Briquetted Iron) is undertaken using heated process gases, preferably in a shaft furnace. In simple terms this involves chemical reactions which convert iron ore ($Fe_20_3$) and natural gas ($CH_4$) into iron Fe, carbon dioxide $CO_2$ and water $H_20$.

The shaft furnace is in continuous operation in that raw material is constantly fed into it from above in the form of iron ore pellets and the sponge iron is withdrawn at the bottom in a similar continuous process.

Methods of producing sponge iron are for example known from U.S. Pat. No. 4,093,455, U.S. Pat. No. 4,178,151, U.S. Pat. No. 4,234,169 and WO 02/097138 A1. Further publications dealing with this subject are: Thompson, M.: "Control Innovations in MIDREX Plants: An Introduction" in "Direct from MIDREX", 1st Quarter 2001, P. 3-4, 2001 and Görner, F., Bacon, F.: "Development of Process Automation for the MIDREX Process" in "Direct from MIDREX", 1st Quarter 2002, P. 3-5, 2002.

In the production of sponge iron it is desirable to produce a product with properties which are as constant as possible and precisely specified. To this end it is known that all factors which might influence the product to be produced are to be kept as constant as possible and thereby the process is to be operated at a known working point. However even the assumption of a fully homogeneous iron ore as raw material for example is often not fulfilled.

SUMMARY OF THE INVENTION

Using this as its starting point, an underlying object of the invention is to predict a property of a product to be produced, especially sponge iron produced by direct reduction.

The general idea underlying the inventions is, in the prognosis of a value of a property to be predicted with the aid of a neuronal network, to take account of the product history by entering values into the prognosis which the property to be predicted exhibits in products already produced. Such values can be taken into account for the determination of an input variable of the neuronal network. As an alternative or in addition it is however also possible, when determining the same input variable or another input variable of the neuronal network, to take account of the difference between a value of the property measured at a specific point in time and the value of the property predicted for this point in time.

Accordingly in a method, especially a production method, a prognosis for a value of a property, especially one that can only be measured in the future, of a product to be manufactured in the present or in the future, is undertaken with the aid of a neuronal network. In this case a value of the property is measured, be it complete or with the aid of spot checks, at different points in time of products produced in the past. Then, from the values of the property measured for the points in time in the past, the value of the property of the product to be manufactured in the present and/or future is predicted in a preliminary prognosis. This involves a prognosis into the unclear so to speak, which only includes the values of the property measured for the times in the past.

This value predicted in the preliminary prognosis is taken into account in determining an input variable for an input neuron of the neuronal network. With the aid of the neuronal network, the value of the property of the product to be produced in the present and/or the future is finally predicted in the actual prognosis.

The preliminary prognosis is preferably undertaken with the aid of a recursive filter. The recursive filter can be implemented relatively simply by performing a linear projection. More precise prognoses are possible by using a second neuronal network as a recursive filter, especially a recurrent neuronal network For this an additional mathematical description of the cause-effect relationship between process parameters and the property is worthwhile.

For determining an input variable of the neuronal network a comparison between a value of the property measured for a point in time in the past and a predicted value of the property for this point in time can however also be taken into account for determining an input variable for the neuronal network.

Accordingly a prognosis of a value of a property which can especially only be measured in the future of a product to be produced in the present or in the future is undertaken with the aid of a neuronal network. To this end a value of the property is measured for a product produced at a specific time. Furthermore a value of the property for the product produced at this time is predicted with the prognosis. To this end the prognosis for the past must be initialized with random or meaningfully selected values from a point even further back in the past. Then the difference between the measured and the predicted value of the property of the product at this point is formed. This difference is included in the determination of an input variable for an input neuron of the neuronal network. With the aid of the neuronal network finally the value of the property of the product to be produced in the present and/or the future is predicted in the prognosis.

The aim of a good prognosis is to intelligently control the production process of a product. In the method or through the method parameters are preferably therefore modified in the production process of the product to be produced until the value of the property of the product to be produced predicted in the prognosis at least approximately matches a required value of the property of the product to be produced.

Although the method described is generally suitable for all possible products, it is however especially relevant to those products for which the properties cannot already be measured during their production or shortly thereafter, but only with a delay of under some circumstances several hours. The method may be used especially advantageously for continuous production processes.

The method of prognosis described is especially suitable for the prognosis of the properties of sponge iron produced in a direct reduction process. Accordingly the property can consist of one or more of the variables given below:

- The degree of metallization, that is the relationship between the absolute iron content in the iron ore and the released iron (Fe),
- the proportion by weight of the sponge iron which is present as metallic iron (Fe),
- the carbon content in the sponge iron.

Naturally it falls within the scope of the invention to use the prognosis method to predict not just one property but a number of properties of the product to be produced.

For the prognosis with the aid of the neuronal network, as well as the history of the products already produced, account should also be taken of further parameters in the production process of the product to be produced, in that they influence or represent input variables of input neurons of the neuronal network. Such parameters are in particular process temperatures, combinations of the process gases used and/or properties of the raw materials.

The invention further relates to an arrangement which is set up to execute the method given here. Such an arrangement can be implemented for example by corresponding programming and setup of a computers or a data processing system. A direct reduction plant can also be part of the arrangement, especially with a shaft furnace.

A program product for a data processing system which contains code sections with which one of the methods described can be executed on the data processing system, can be executed through suitable implementation of the method in a programming language and compilation into code which can be executed by the data processing system. The sections of code are stored for this purpose. In this case a computer program product is taken to mean the program as a marketable product. It can be available in any form, for example on paper, on a computer-readable data medium or distributed over a network.

Using this as its starting point, an underlying object of the invention is to predict a property of a product to be produced, especially sponge iron produced by direct reduction.

The general idea underlying the inventions is, in the prognosis of a value of a property to be predicted with the aid of a neuronal network, to take account of the product history by entering values into the prognosis which the property to be predicted exhibits in products already produced. Such values can be taken into account for the determination of an input variable of the neuronal network. As an alternative or in addition it is however also possible, when determining the same input variable or another input variable of the neuronal network, to take account of the difference between a value of the property measured at a specific point in time and the value of the property predicted for this point in time.

Accordingly in a method, especially a production method, a prognosis for a value of a property, especially one that can only be measured in the future, of a product to be manufactured in the present or in the future, is undertaken with the aid of a neuronal network. In this case a value of the property is measured, be it complete or with the aid of spot checks, at different points in time of products produced in the past. Then, from the values of the property measured for the points in time in the past, the value of the property of the product to be manufactured in the present and/or future is predicted in a preliminary prognosis. This involves a prognosis into the unclear so to speak, which only includes the values of the property measured for the times in the past.

This value predicted in the preliminary prognosis is taken into account in determining an input variable for an input neuron of the neuronal network. With the aid of the neuronal network, the value of the property of the product to be produced in the present and/or the future is finally predicted in the actual prognosis.

The preliminary prognosis is preferably undertaken with the aid of a recursive filter. The recursive filter can be implemented relatively simply by performing a linear projection. More precise prognoses are possible by using a second neuronal network as a recursive filter, especially a recurrent neuronal network For this an additional mathematical description of the cause-effect relationship between process parameters and the property is worthwhile.

For determining an input variable of the neuronal network a comparison between a value of the property measured for a point in time in the past and a predicted value of the property for this point in time can however also be taken into account for determining an input variable for the neuronal network.

Accordingly a prognosis of a value of a property which can especially only be measured in the future of a product to be produced in the present or in the future is undertaken with the aid of a neuronal network. To this end a value of the property is measured for a product produced at a specific time. Furthermore a value of the property for the product produced at this time is predicted with the prognosis. To this end the prognosis for the past must be initialized with random or meaningfully selected values from a point even further back in the past. Then the difference between the measured and the predicted value of the property of the product at this point is formed. This difference is included in the determination of an input variable for an input neuron of the neuronal network. With the aid of the neuronal network finally the value of the property of the product to be produced in the present and/or the future is predicted in the prognosis.

The aim of a good prognosis is to intelligently control the production process of a product. In the method or through the method parameters are preferably therefore modified in the production process of the product to be produced until the value of the property of the product to be produced predicted in the prognosis at least approximately matches a required value of the property of the product to be produced.

Although the method described is generally suitable for all possible products, it is however especially relevant to those products for which the properties cannot already be measured during their production or shortly thereafter, but only with a delay of under some circumstances several hours. The method may be used especially advantageously for continuous production processes.

The method of prognosis described is especially suitable for the prognosis of the properties of sponge iron produced in a direct reduction process. Accordingly the property can consist of one or more of the variables given below:

- The degree of metallization, that is the relationship between the absolute iron content in the iron ore and the released iron (Fe),
- the proportion by weight of the sponge iron which is present as metallic iron (Fe),
- the carbon content in the sponge iron.

Naturally it falls within the scope of the invention to use the prognosis method to predict not just one property but a number of properties of the product to be produced.

For the prognosis with the aid of the neuronal network, as well as the history of the products already produced, account should also be taken of further parameters in the production process of the product to be produced, in that they influence or represent input variables of input neurons of the neuronal network. Such parameters are in particular process temperatures, combinations of the process gases used and/or properties of the raw materials.

The invention further relates to an arrangement which is set up to execute the method given here. Such an arrangement can be implemented for example by corresponding programming and setup of a computers or a data processing system. A direct reduction plant can also be part of the arrangement, especially with a shaft furnace.

A program product for a data processing system which contains code sections with which one of the methods described can be executed on the data processing system, can be executed through suitable implementation of the method in a programming language and compilation into code which can be executed by the data processing system. The sections of code are stored for this purpose. In this case a computer program product is taken to mean the program as a marketable product. It can be available in any form, for example on paper, on a computer-readable data medium or distributed over a network.

BRIEF DESCRIPTION OF THE DRAWINGS

These and other objects and advantages of the present invention will become more apparent and more readily appreciated from the following description of an exemplary embodiment, taken in conjunction with the accompanying drawings of which.

DETAILED DESCRIPTION OF THE PREFERRED EMBODIMENT

Figure 1:
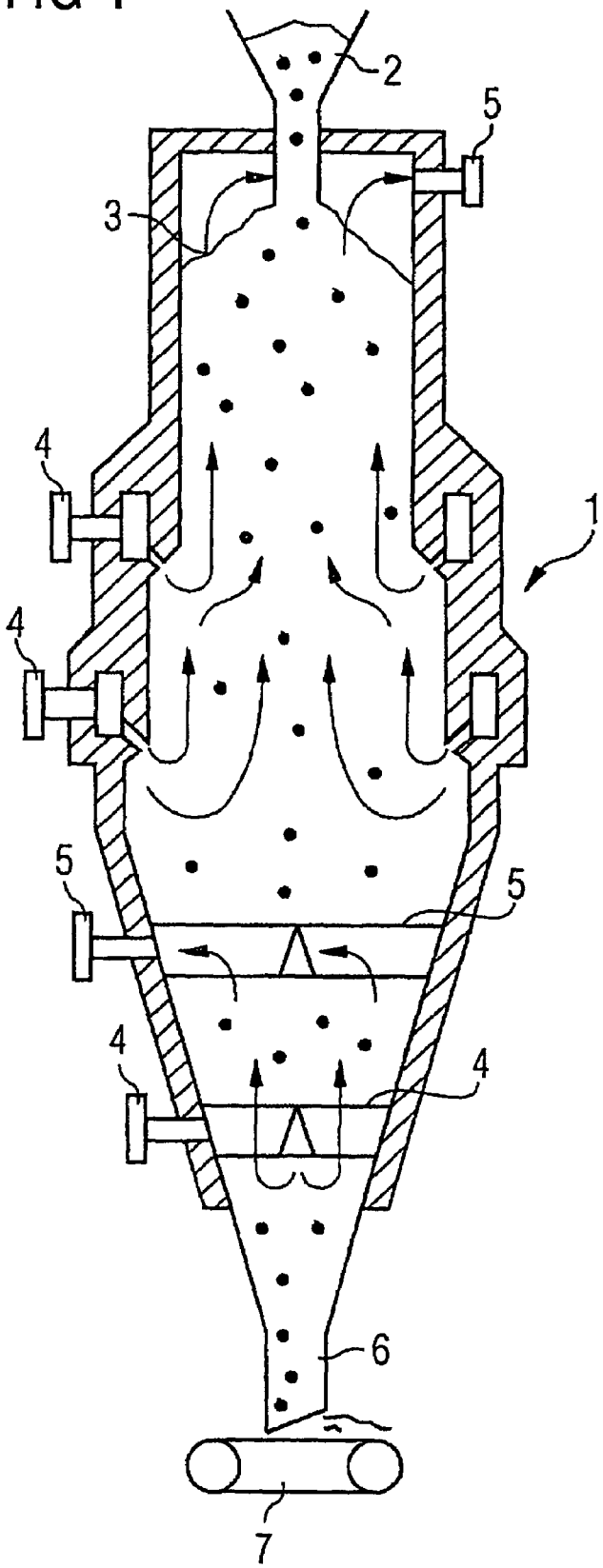
FIG. 1 is a cross section of a shaft furnace for producing sponge iron.

Reference will now be made in detail to the preferred embodiments of the present invention, examples of which are illustrated in the accompanying drawings, wherein like reference numerals refer to like elements throughout.

FIG. 1 shows a shaft furnace 1 with a feed 2 for feeding in the iron ore pellets which pile up into one or more piles 3 within the shaft furnace 1. The shaft furnace 1 further features components 4 for feeding in reaction gases, especially oxygen and carbon monoxide, and components 5 drawing off reaction gases, especially carbon dioxide and water.

Inside the shaft furnace 1 the iron ore is reduced at high temperature and under the effects of the process gases in a direct reduction process to sponge iron, which is removed at the lower end of the furnace via a removal device 6 and taken away on a conveyor belt 7.

At regular intervals, for example every two to four hours, samples of cooled products are taken and investigated in the laboratory for the properties of metallization or carbon content. The time difference from the conclusion of the production process to the evaluated sample is around 5 to 9 hours for the metallization and around 3.5 to 7.5 hours for enrichment with carbon. The reason for this is that metallization is completed as a subprocess, approximately in the center of the shaft furnace 1. The product produced however remains in the shaft furnace 1 for some further time, around 3 hours, to cool off, before being let though to the removal device 6 to leave the furnace. The subprocess enrichment with carbon is completed in around three quarters of the time, i.e. after around 4.5 hours. In addition around 2 hours are needed in the laboratory for the measurement of the metallization value and the measurement of the carbon enrichment value. Under conditions where the measurement is taken every 4 hours, this produces a dead time of 5 to 9 or 3.5 to 7.5 hours respectively.

Under the condition that all influencing factors remain constant, this allows regular interventions to be made into the ongoing process. For the preceding 3.5 to 9 hours of the process however there is no further opportunity to intervene. In practice it is additionally not possible to keep all influencing factors constant.

Figure 2:
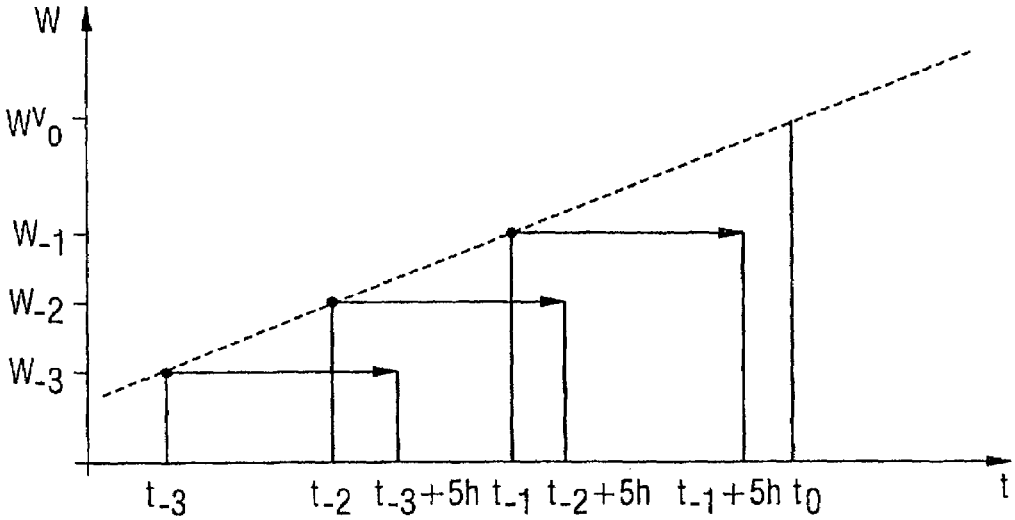
FIG. 2 is a graph of a preliminary prognosis of a value of a property of a product to be produced based on values of the properties of products already produced.

FIG. 2 shows that the value $W_{-3}$ of a property, that is for example of the metallization or of the carbon content of the product, present at the point $t_{-3}$, cannot be measured until the point $t_{-3}+5$ hours. The same applies in a similar fashion for the value $W_{-2}$ of the property of the product at point $t_{-2}$ and the value $W_{-1}$ of the product at the point $t_{-1}$, which can also not be measured until 5 hours after production.

From the measured values $W_{-3}$, $W_{-2}$ and $W_{-1}$, which for example specify a metallization of 94.1%, 94.2% and 94 3%, the value $W^{V}_{p,0}$ of the property to be produced at the current time $t_0$ is now predicted in a preliminary prognosis. In the exemplary embodiment shown in FIG. 2 this is done simply by linear prediction, which is indicated by the dashed line. However more complicated algorithms can also be used here.

The value $W^{V}_{0}$ predicted in the preliminary prognosis is now taken into account for the determination of an input variable for an input neuron of a neuronal network.

Figure 3:
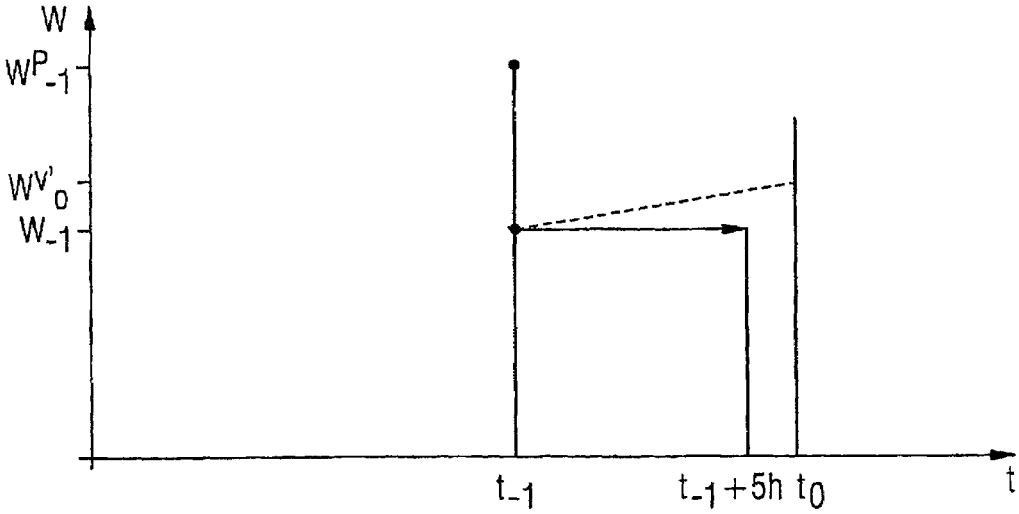
FIG. 3 is a graph of a preliminary prognosis of a value of a product to be produced based on a measured value of the property for a product already produced and on a predicted value of the property for this product already produced.

In addition, as shown in FIG. 3, the difference between a value $W_{-1}$ measured at a point $t_{-1}$ in the past and a value $W_{p,-1}$ predicted for this point in time with the actual prognosis P is taken into account in a second preliminary prognosis V'.

This is done using the following formula:

$$W^{V'}_{0}=W_{-1}+\alpha\cdot(W^{P}_{-1}-W_{-1});$$

With $\alpha=\{0; 1\}$, for example $\alpha=0.25$.

This value $W^{V'}0$ of a second prognosis formed taking into account the difference between the measured value $W_{-1}$ and the value $W^{P}_{-1}$ of the property of the product at time $t_{-1}$ predicted by the prognosis, is now used as the input variable for a second input neuron of the neuronal network.

The input variables of further input neurons of the neuronal network are formed by further process parameters or calculated taking into account further process parameters. Such process parameters are:

- The composition of all process gases (dry and wet), used in the direct reduction plant,
- Information about quantities and times for gas throughflows (for example tons per hours) and temperature,
- All temperature measurements in and at the shaft furnace,
- Properties describing the raw material (porosity, chemical composition, size and form of the pellets, density, temperature),
- Properties describing the product produced or to be produced (density, chemical composition, carbon content, iron content, metallic iron content, degree of metallization),
- Mass flows of the raw material and of the end product, and of
- Air (temperature and humidity over time).

Advantageously around 100 measured and computed input variables are included in the model calculation.

With the neuronal network It has proved especially advantageous to use an ensemble of neuronal networks and to evaluate their median. A combination of Feed-Forward networks with recursive filters is also advantageous.

Some of the preferred training methods for the neuronal network are as follows: The use of digital filters for the training data, an automatic exception removal, bagging, adherence to peripheral conditions for the monotony as regards relevant control variables and target variables.

The input variables of the neuronal network are preferably analytically modelled from the given process parameters. This is done for example by the integration of variables, the quantitative description of chemical conversion including the reaction kinetics with the aid of differential equations and a calculation as to when which item of material is where in the shaft furnace, with the aid of a product yield per hour.

For execution different, linked software programs in Fortran, C, C++ and MATLAB are advantageously used. A user interface can be programmed in Visual-Basic.

The invention provides the following advantages:

The deviation of predetermined required values can be reduced. In practice a reduction of the standard deviation by appr. 40% for metallization and appr. 30% for carbon content is produced.

Lower deviations allow an operation of the shaft furnace which is closer to the optimum, which benefits throughput and quality.

A production increase of appr. 1% is achieved.

Through the more constant and higher material quality the consumers of the sponge iron, namely network operators of electric arc furnaces, can operate their furnaces more efficiently. This advantage is even greater than the advantage for operation of the direct reduction plant, so that correspondingly higher prices can be obtained for the product produced.

Computation of the material properties can save on laboratory samples.

The computation can be undertaken at any time. This means that current values can be computed every 0.1 seconds for example, instead of being analyzed in the laboratory every two to four hours.

Since definitive chemical reactions are completed within the first half or the first third of the process of appr. 6 hours, the material properties can already be determined before the sponge iron is removed from the shaft furnace. This reduces the reaction times for regulation of the material properties from 3.5 to 9 hours to the calculation time for the model, which lies below 0.1 seconds.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A production method for predicting, using a first neuronal network, a value of a property of a product to be produced, comprising:

subjecting a production process including a direct reduction of the product having a metallic iron content property to a non-linear dynamic; and using a computer executing operations of:

measuring values of the property of the product as produced at different times;

predicting in a preliminary prognosis a preliminary value of the property of the product to be produced, according to a measured value of the property of the product to be produced;

determining an input variable for an input neuron of the first neuronal network, taking into account the preliminary value; and predicting the value of the property of the product to be produced in a subsequent prognosis using the first neuronal network, where the first neuronal network includes a non-linear part.

2. A method in accordance with claim 1, wherein said predicting in the preliminary prognosis utilizes a recursive filter.

3. A method in accordance with claim 2, wherein the recursive filter includes a linear projection.

4. A method in accordance with claim 3, wherein the recursive filter includes a second, recurrent neuronal network.

5. A method in accordance with claim 4, further using the computer to execute an operation comprising measuring a reference value of the property of the product, wherein said predicting in the preliminary prognosis obtains an estimated value of the property of the product, and wherein said determining includes calculating a difference between the reference value and the estimated value of the property of the product, used to determine the input variable for the input neuron of the neuronal network.

6. A method in accordance with claim 5, further using the computer to execute an operation comprising changing parameters in the production process of the product, until the value of the property of the product predicted in the subsequent prognosis substantially corresponds to a required value of the property of the product.

7. A method in accordance with claim 1, wherein the product contains iron sponge.

8. A method in accordance with claim 1, wherein the property of the product is carbon content.

9. A method in accordance with any of claims 1-6, 7 or 8.

wherein said subsequent prognosis using the first neuronal network takes into account parameters in the production process of the product, including one or more of process temperatures, compositions of process gases used, properties of raw materials and parameters determined through analytical computations of chemical conversions or reaction kinetics.

10. A computer readable data medium storing instructions that when loaded and executed on a computer controls the computer to perform the computer implemented operations in any of claims 1 to 6, 7 or 8.

* * * * *